US009909276B2

(12) United States Patent
Thompson et al.

(10) Patent No.: US 9,909,276 B2
(45) **Date of Patent: *Mar. 6, 2018**

(54) PICK HOLE GUARD FOR MANHOLE COVERS

(71) Applicant: 6672205 CANADA INCORPORATED, Coquitlam (CA)

(72) Inventors: Tina Thompson, Coquitlam (CA); Ted Gilligan, Burnaby (CA); Mark Taylor, Seattle, WA (US)

(73) Assignee: 6672205 CANADA INCORPORATED, Coquitlam, BC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,637

(22) Filed: Aug. 16, 2016

(65) Prior Publication Data

US 2017/0138014 A1 May 18, 2017

Related U.S. Application Data

(63) Continuation of application No. 14/050,079, filed on Oct. 9, 2013, now Pat. No. 9,447,559, which is a continuation of application No. 13/090,249, filed on Apr. 19, 2011, now Pat. No. 8,579,541, which is a continuation of application No. 12/025,707, filed on Feb. 4, 2008, now abandoned.

(60) Provisional application No. 60/899,442, filed on Feb. 5, 2007, provisional application No. 60/899,689, filed on Feb. 6, 2007, provisional application No. 60/941,681, filed on Jun. 3, 2007, provisional application No. 60/934,445, filed on Jun. 13, 2007, provisional application No. 60/937,714, filed on Jun. 29, 2007.

(51) Int. Cl.
*E02D 29/14* (2006.01)

(52) U.S. Cl.
CPC ..... *E02D 29/1481* (2013.01); *E02D 29/14* (2013.01); *E02D 29/1418* (2013.01); *E02D 2200/1628* (2013.01)

(58) Field of Classification Search
CPC ..... E02D 29/14
USPC ..... 404/25; 296/97.22
See application file for complete search history.

(56) References Cited

U.S. PATENT DOCUMENTS 1,720,444 A * 7/1929 Rowley ..... F16K 15/03 137/527.8
2,587,358 A * 2/1952 McRae ..... F16K 15/03 137/463
2,680,965 A * 6/1954 Jacobi ..... E05B 17/181 70/455
3,921,494 A * 11/1975 Coe ..... F16B 21/10 292/192

(Continued)

*Primary Examiner* — Abigail A Risic
(74) *Attorney, Agent, or Firm* — DWC Law Firm, P.S.; David Chen

(57) ABSTRACT

Pick hole guards are provided for use in guarding pick holes on manhole covers. In some embodiments of the present disclosure, the pick hole guards can have a base, biasing member, and guard member. The biasing member can be attached to the base and guard member, and can bias the guard member toward a pick hole on the manhole cover to guard the pick hole. In other embodiments, the pick hole guards do not have movable guard members, but instead have retaining surfaces to serve as a receptacle for catching waste disposed through a pick hole.

15 Claims, 19 Drawing Sheets

(56) References Cited

U.S. PATENT DOCUMENTS

| | | | | | |
|---|---|---|---|---|---|
| 4,597,692 | A * | 7/1986 | Gruenwald | E02D 29/14 | 220/287 |
| 5,152,662 | A * | 10/1992 | Hirst | F01D 21/003 | 415/118 |
| 6,123,528 | A * | 9/2000 | Sun | F04C 29/128 | 137/527 |
| 6,616,370 | B1 * | 9/2003 | Signorelli | B65D 90/48 | 404/25 |
| 6,972,088 | B2 * | 12/2005 | Yehuda | E03F 1/00 | 210/156 |
| 7,163,037 | B2 * | 1/2007 | Walkowski | B60K 15/0406 | 141/350 |
| 7,178,290 | B2 * | 2/2007 | Gowland | E02D 29/1427 | 49/169 |
| 2010/0072774 | A1 * | 3/2010 | Bar | B60K 15/0406 | 296/97.22 |

* cited by examiner

PICK HOLE GUARD FOR MANHOLE COVERS

CROSS-REFERENCE TO RELATED APPLICATION(S)

This application is a continuation of prior U.S. patent application Ser. No. 14/050,079, filed Oct. 9, 2013, which is a continuation of U.S. patent application Ser. No. 13/090,249, filed Apr. 19, 2011, which is a continuation of U.S. patent application Ser. No. 12/025,707, filed Feb. 4, 2008, which claims the benefit of U.S. provisional patent application Ser. No. 60/899,442, filed Feb. 5, 2007, U.S. provisional patent application Ser. No. 60/899,689, filed Feb. 6, 2007, U.S. provisional patent application Ser. No. 60/941,681, filed Jun. 3, 2007, U.S. provisional patent application Ser. No. 60/934,445, filed Jun. 13, 2007, and U.S. provisional patent application Ser. No. 60/937,714, filed Jun. 29, 2007, all of which are incorporated herein by reference in their entireties.

BACKGROUND

1. Field of the Disclosure

The present disclosure relates to pick hole guards for manhole covers.

2. Description of Related Art

Manholes are commonly found in urban environments, and elsewhere, and are constructed to provide access to underground utility systems, such as telephone, electric, gas and sewage systems. Manholes are almost always provided with "manhole covers" to secure the manholes from unauthorized access and to protect pedestrians from injury. The manhole covers often weigh in excess of 50 kilograms (100 pounds) and rest on a ridge of a support ring at the entrance of the manhole, with the edges of the manhole cover being snugly fit near, or against, inner facing walls of the support ring. As such, "pick holes" are typically formed in the manhole covers through which hook devices can be inserted for use in lifting the manhole covers when authorized personnel need access to the manholes.

Unfortunately, an undesirable consequence of having the pick holes (which are typically about ¾ inch or more in diameter) is that they are often indiscreetly used to dispose of undesirable and dangerous waste products. One epidemic that has plagued some cities is that used hypodermic needles and other waste products are thrown into the pick holes by users of illegal substances. This presents health hazards and dangers for maintenance people who service underground utilities, not to mention an environmental hazard to the general public.

U.S. Pat. No. 5,230,583 to Johnson describes a "Method of sealing openings in manhole covers using a pick hole plug." A plug is formed in a pick hole of a manhole cover using soft rubber, which is allowed to cure in the pick hole in order to seal it. In order to remove the plug, it must be driven through the pick hole, and then recovered. Disadvantages of this method include, without limitation, having to recover the plug in the manhole, or elsewhere, assuming it is not destroyed or lost after being driven through. Also, the process of forming the plug in the pick hole when the plug is lost or destroyed is inconvenient and time consuming.

U.S. Pat. No. 5,056,955 to Spiess et al., relates to a "quick release locking means for a cover" for a manhole. The disclosure includes a manhole cover with cross-shaped slots and fixing plates, and therefore requires a modified manhole cover that may need to be manufactured. Disadvantages to this design, include, without limitation, that in order to replace the numerous (e.g., hundreds of thousands, if not millions) existing manholes, expenses would be very high.

U.S. Pat. No. 5,909,991 to Manion et al., also relates to a plug for openings on manhole covers. The plug has a shaft formed with projections. The projections are inserted into an opening on a manhole cover and contact the inside walls of the openings to help secure the plug in place. Again, the plugs must be removed to access the openings by pulling the plugs out of the openings and may require a tool, such as a screw driver, as suggested in the patent. As will be appreciated by those skilled in the art, removal of plugs from openings can be tedious if tightly fit and can often damage plugs. Also, it is noted that failure to keep track of the plugs once removed could result in significant moneys wasted. These are just some of the disadvantages noted in the prior publications.

BRIEF SUMMARY

Some embodiments of the present disclosure comprise spring loaded pick hole guards. The pick hole guards can be conveniently attached to existing manhole covers to guard pick holes. The embodiments of the pick hole guard can include a movable guard member that is biased toward a pick hole. The force of a biasing member can be designed to prevent casual access to the pick hole such as by, for example, being significant enough to require a person to utilize a heavy tool (such as a pick hole hook), or a tool that permits significant weight to be applied to the tool in order to deflect the movable guard member to access the pick hole. Also, the force of the biasing member can be significant enough to bend or break hypodermic needles or syringes when they are used to try to deflect the movable guard member. In these manners, people can be dissuaded from inserting waste products into the pick holes, as it will both be inconvenient and conspicuous to do so. At the same time, the hassle or tedium associated with having to track and replace pick hole plugs in the openings is eliminated during maintenance. Instead, the pick hole guard automatically closes to guard the pick hole, once a pick hole hook is removed from the pick hole.

Other embodiments of the present disclosure, comprise manhole cover assemblies having pick hole guards that serve as receptacles having vent gaps. The receptacles are each coupled to a manhole cover and positioned beneath a pick hole of the manhole cover. The receptacles can each have at least one retaining surface spaced-apart from the pick hole which they guard, with a vent gap on the retaining surface.

A push rod having a hollow chamber is also provided for use with some embodiments of the present disclosure involving spring-loaded pick hole guards. The push rod can be used to actuate a pick hole guard to gain access to the pick hole. The hollow chamber of the push rod can be used as a passageway through which to obtain samples of the environment in a manhole for use in detection and sampling.

BRIEF DESCRIPTION OF THE SEVERAL VIEWS OF THE DRAWING(S)

FIG. 1*a* is a perspective view of an embodiment of a coil spring pick hole guard of the present disclosure.

FIG. 1*b* is a detail cross sectional view of the pivot rod of FIG. 1*a*, having a concentric connection pin, as viewed from line FIG. 1*b*-FIG. 1*b* in FIG. 1*a*.

Figure 2:
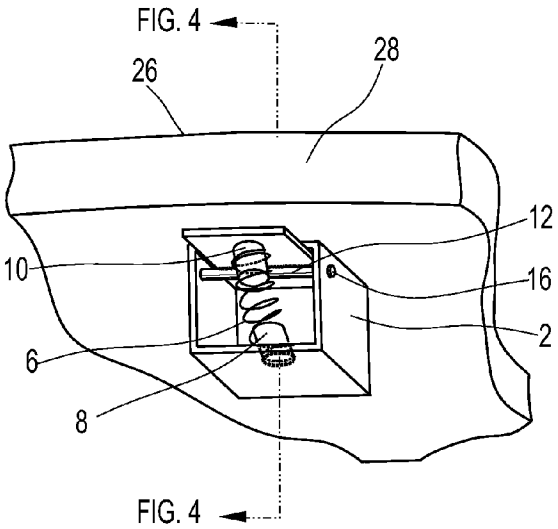
FIG. 2 is a perspective view of the pick hole guard of FIG. 1, shown coupled to a section of a manhole cover.
Figure 6B:
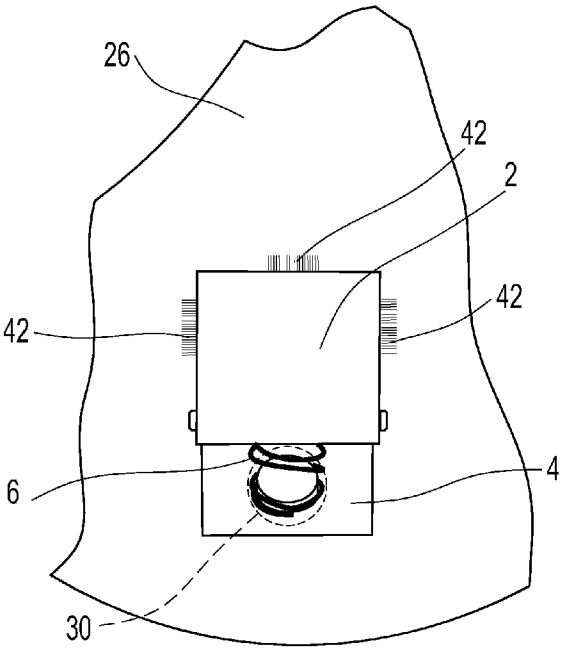
Figure 6A:
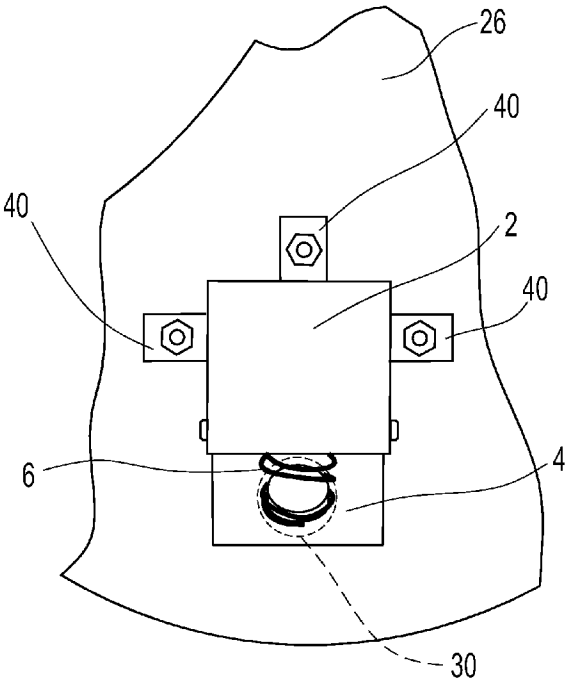

FIG. 6*a* is a plan view of the pick hole guard of FIG. 2, showing the pick hole guard as being bolt-coupled to the manhole cover.

FIG. 6*b* is a plan view of the pick hole guard of FIG. 2, showing the pick hole guard as being welded to the manhole cover.

Figure 7:
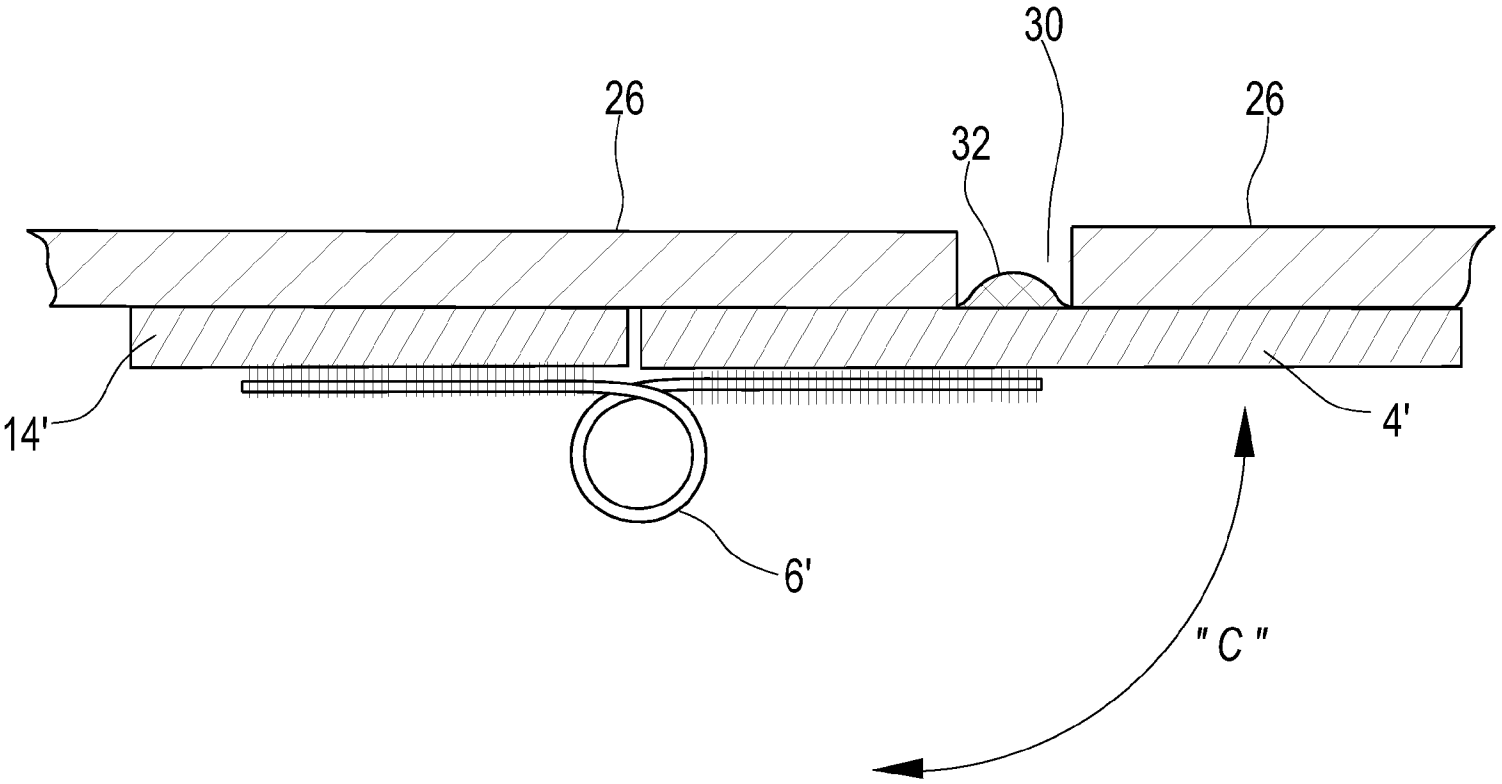

FIG. 7 is an elevation cross sectional view of an alternative embodiment of a pick hole guard of the present disclosure.

Figure 8:
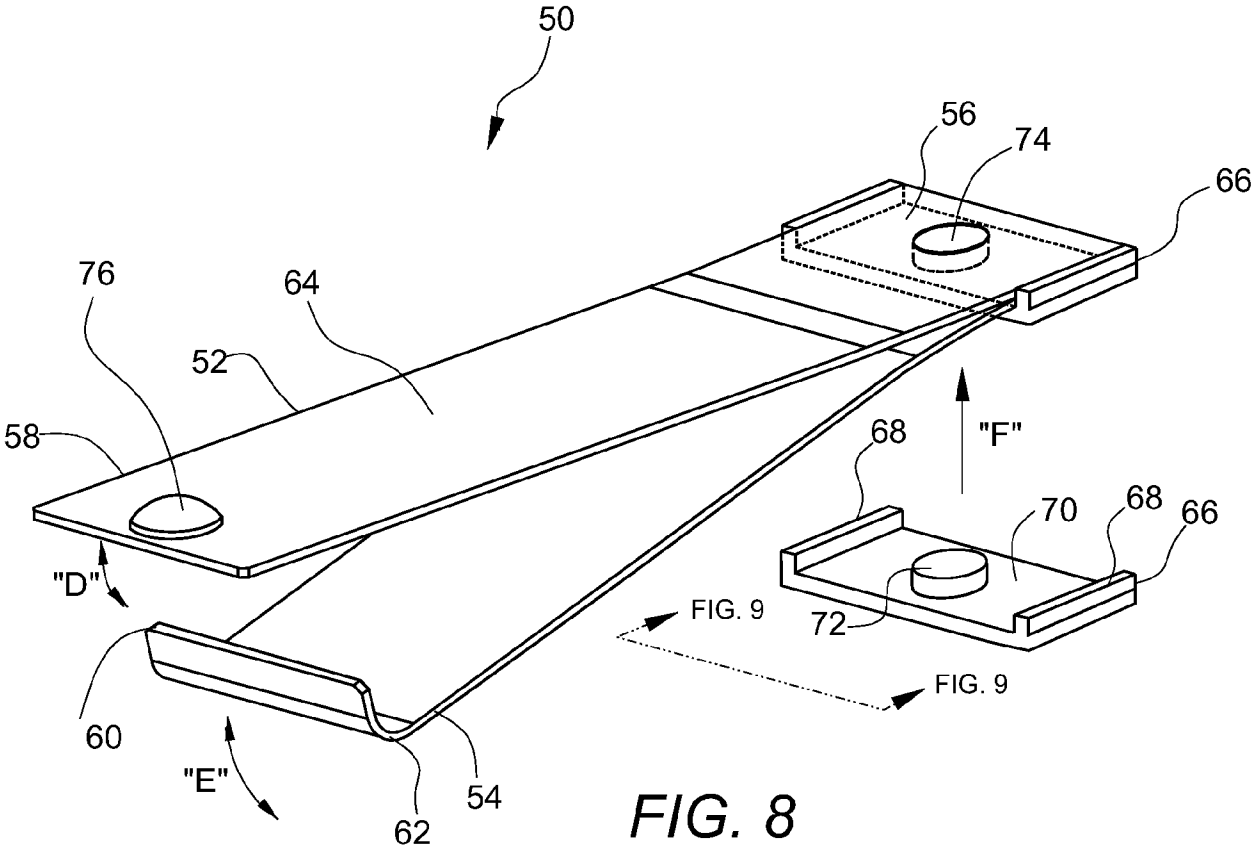

FIG. 8 is a perspective view of an alternative embodiment of the pick hole guard of the present disclosure, having dual biasing members.

Figure 9:
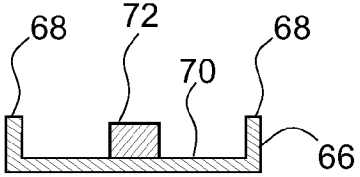

FIG. 9 is an elevation view of the retaining member for the pick hole guard of FIG. 8, as viewed from line FIG. 9-FIG. 9 of FIG. 8.

Figure 10:
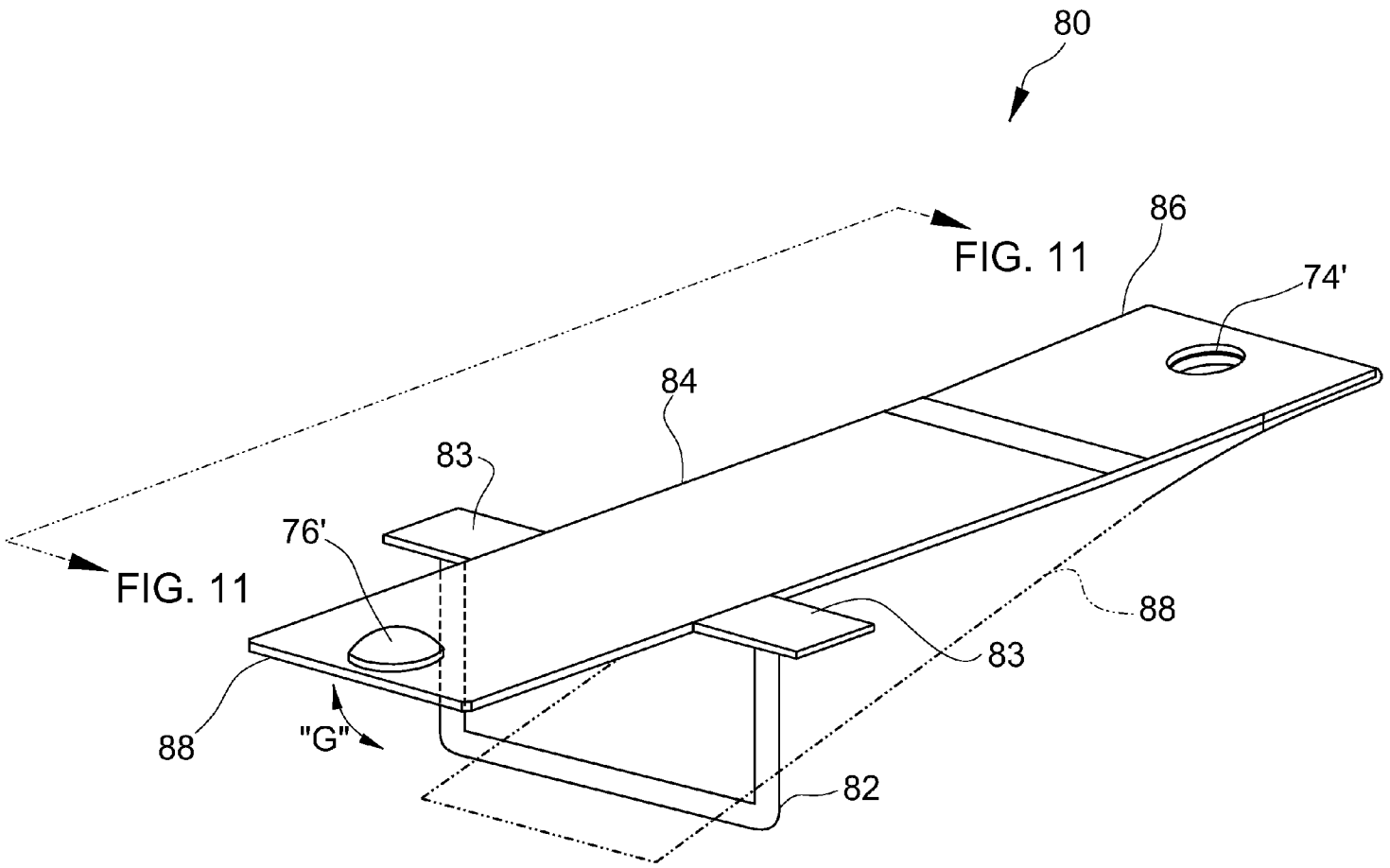

FIG. 10 is a perspective view of an alternative embodiment of the pick hole guard of the present disclosure, having a hard stop member.

Figure 11:
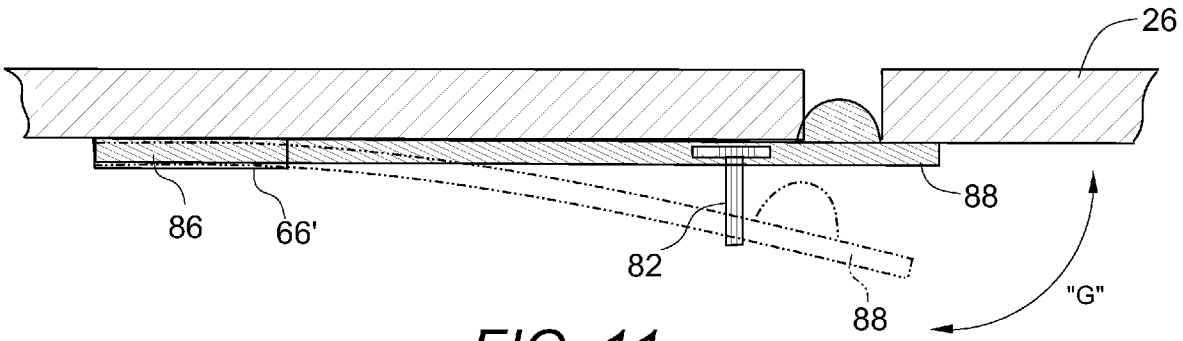

FIG. 11 is a simplified elevation cross sectional view of the pick hole guard of FIG. 10, attached to a manhole cover.

Figure 12:
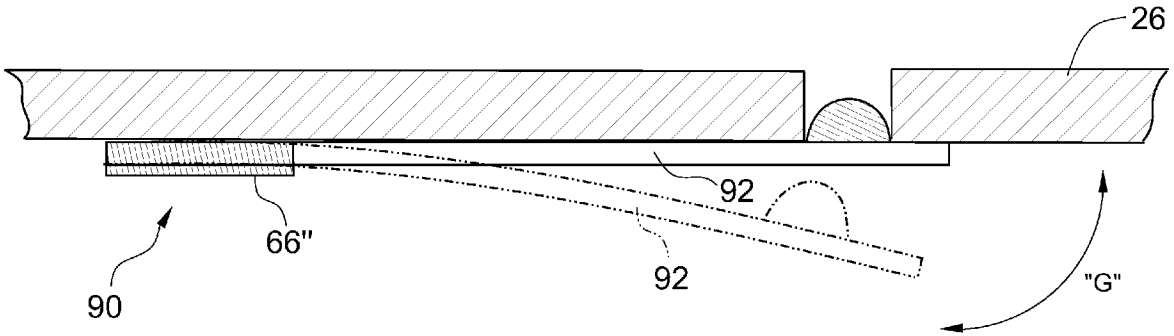

FIG. 12 is a simplified elevation cross sectional view of an alternative embodiment of a pick hole guard of the present disclosure.

Figure 13:
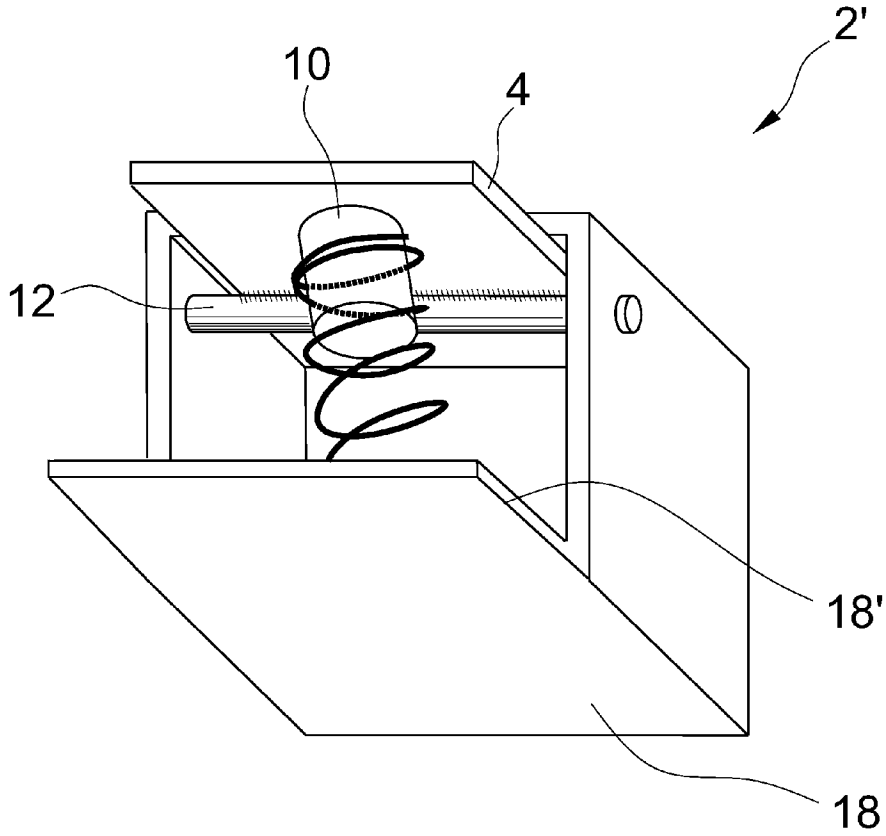

FIG. 13 is a perspective view of an alternative embodiment of a pick hole guard having a hard stop member that extends forward from the bottom wall.

Figure 14A:
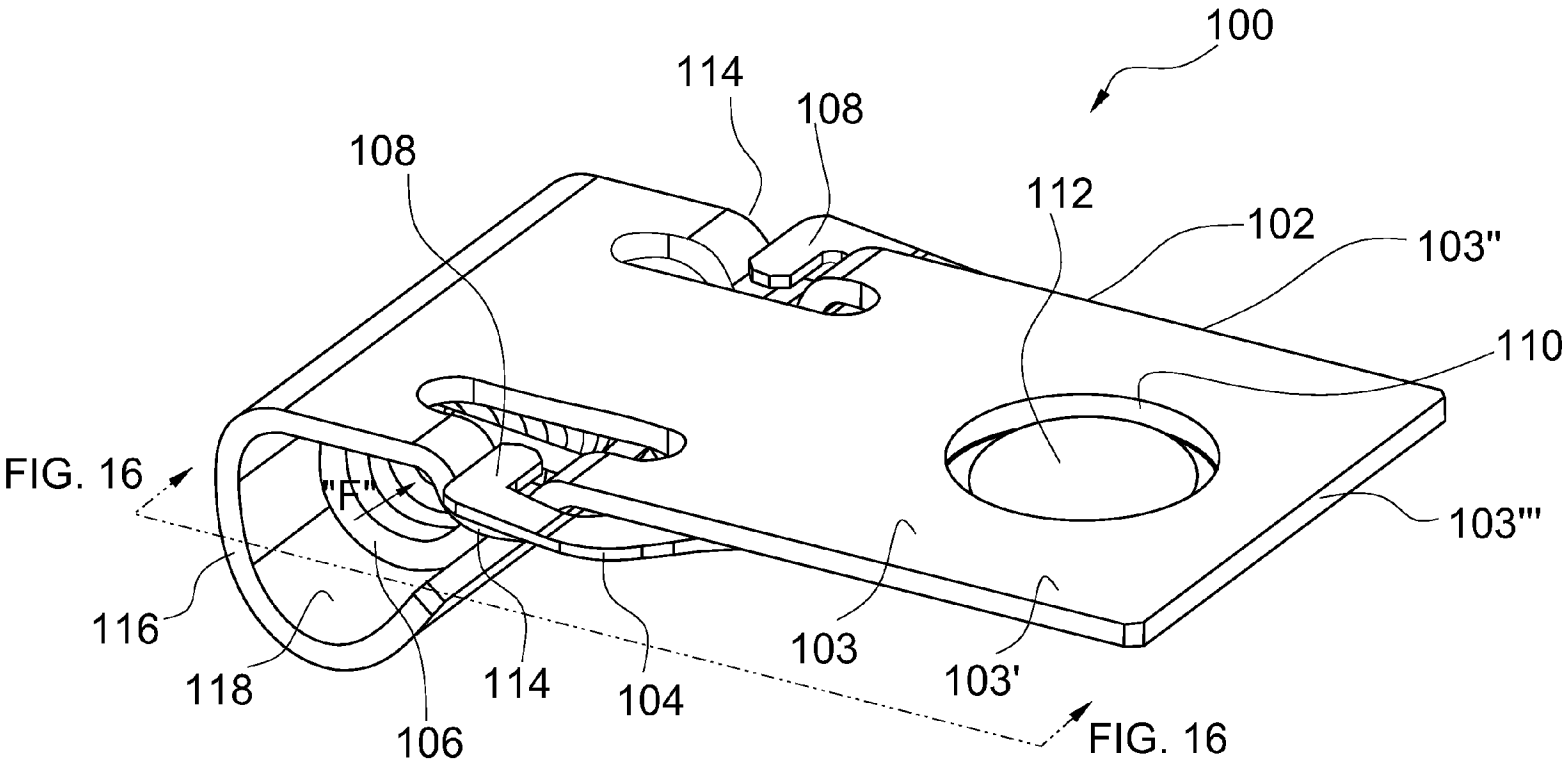

FIG. 14*a* is a perspective view of another example embodiment of a pick hole guard of the present disclosure, having a torsion spring biasing member.

Figure 14B:
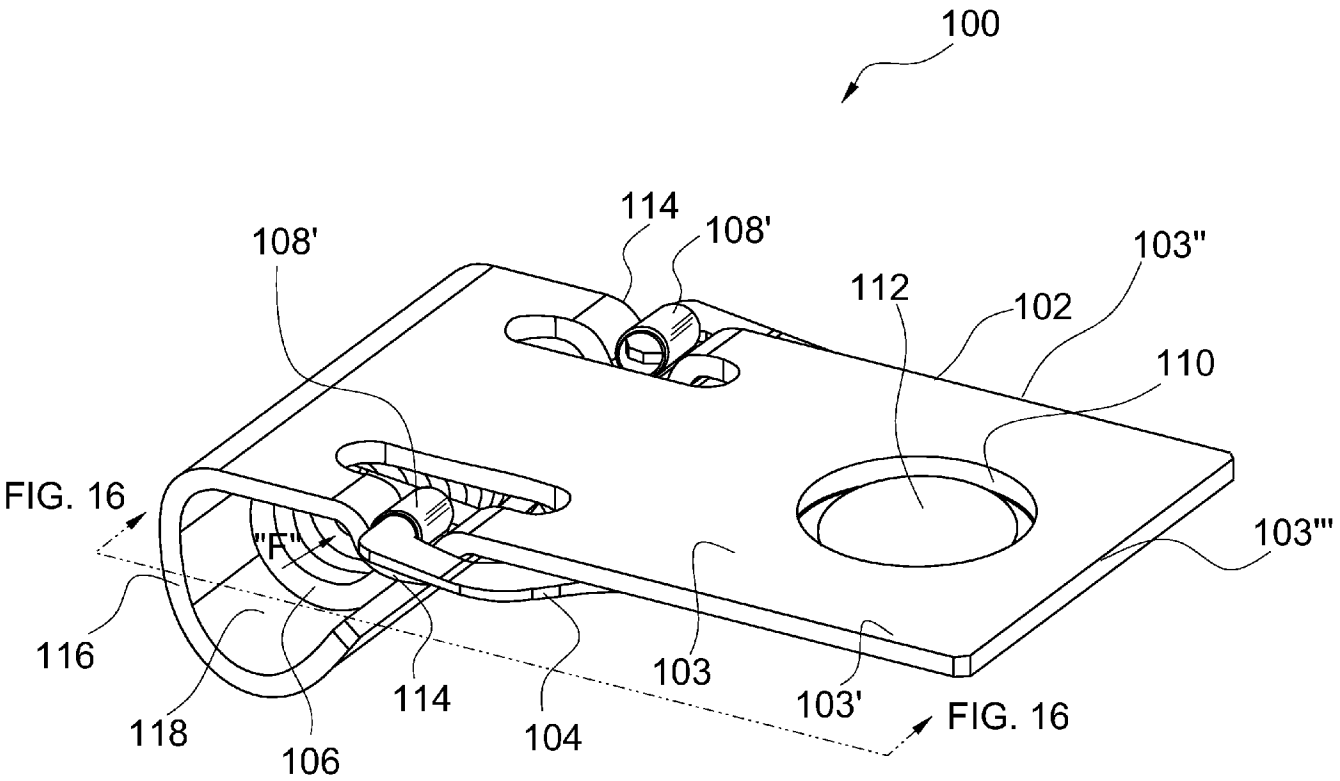

FIG. 14*b* is a perspective view of the pick hole guard of FIG. 14*a*, with the addition of sleeves disposed over the pivot flaps.

Figure 15:
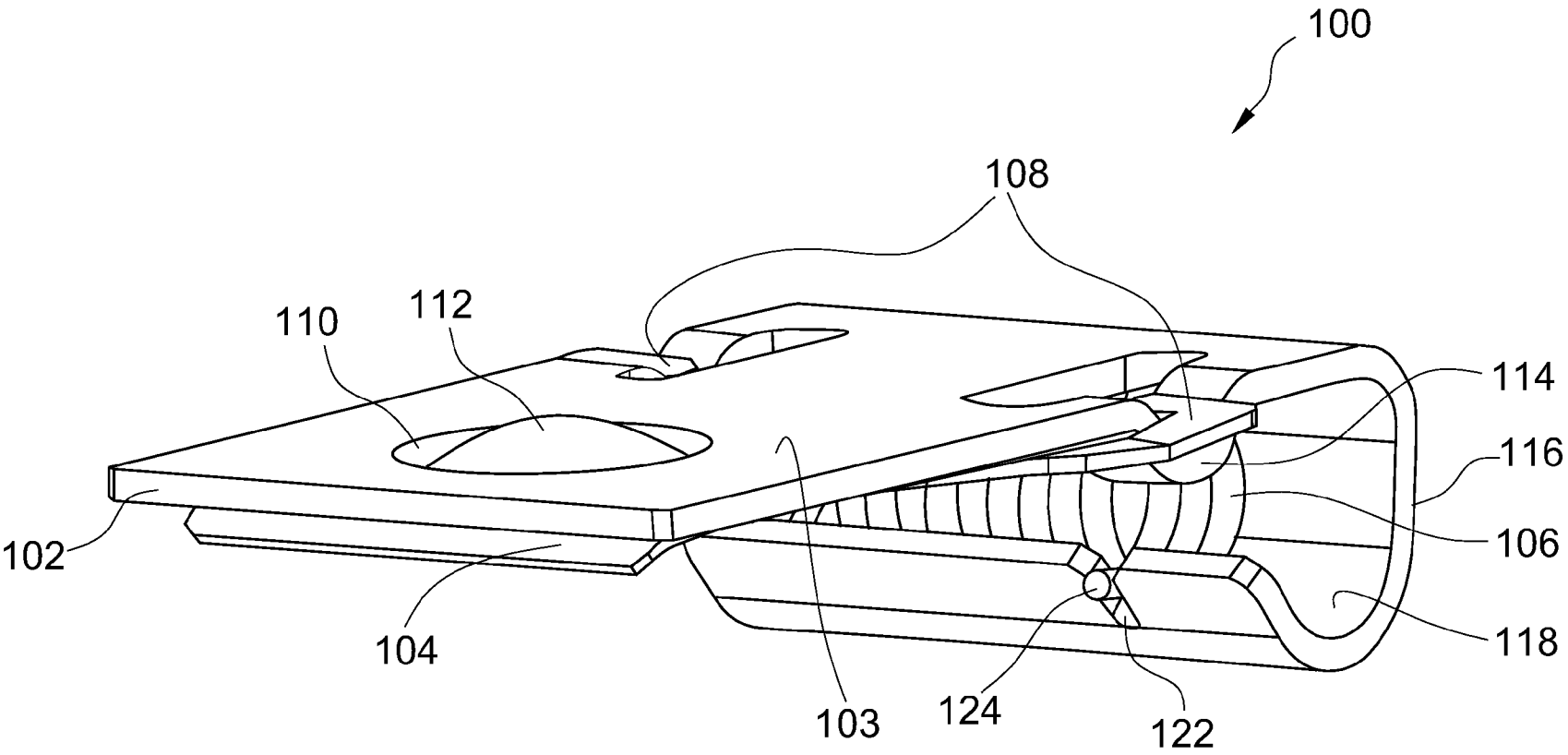

FIG. 15 is a second perspective view of the embodiment of the pick hole guard of the present disclosure shown in FIG. 14*a*.

Figure 16:
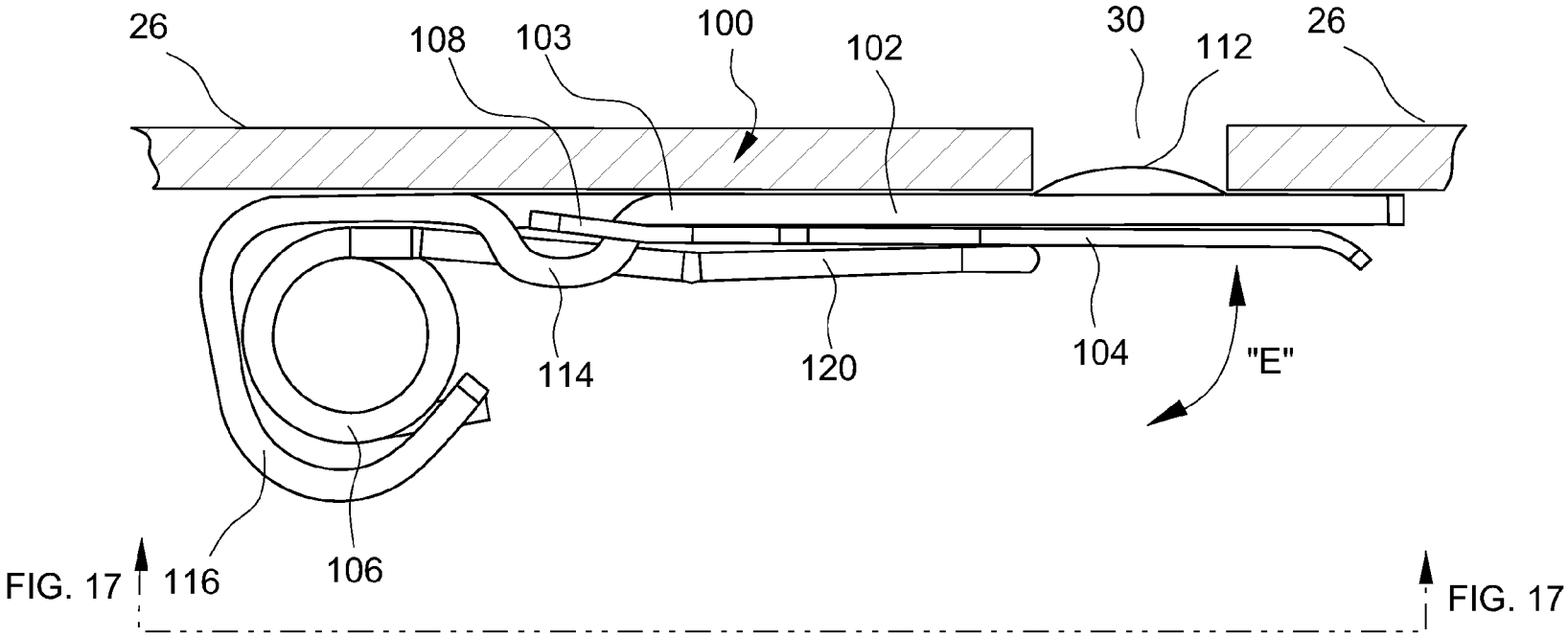

FIG. 16 is a side elevation view of the pick hole guard of FIG. 14*a*, as viewed from line FIG. 16-FIG. 16 of FIG. 14*a*.

Figure 17:
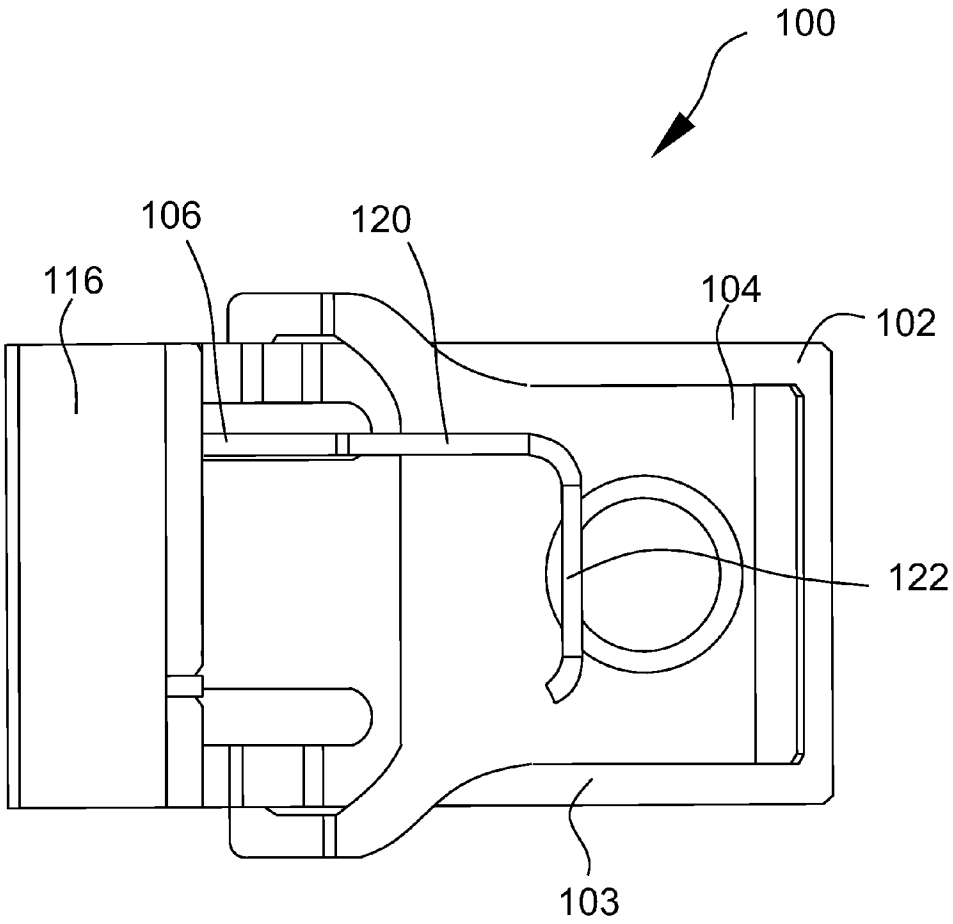

FIG. 17 is a bottom plan view of the pick hole guard of FIG. 17, as viewed from line FIG. 17-FIG. 17 of FIG. 16.

Figure 18:
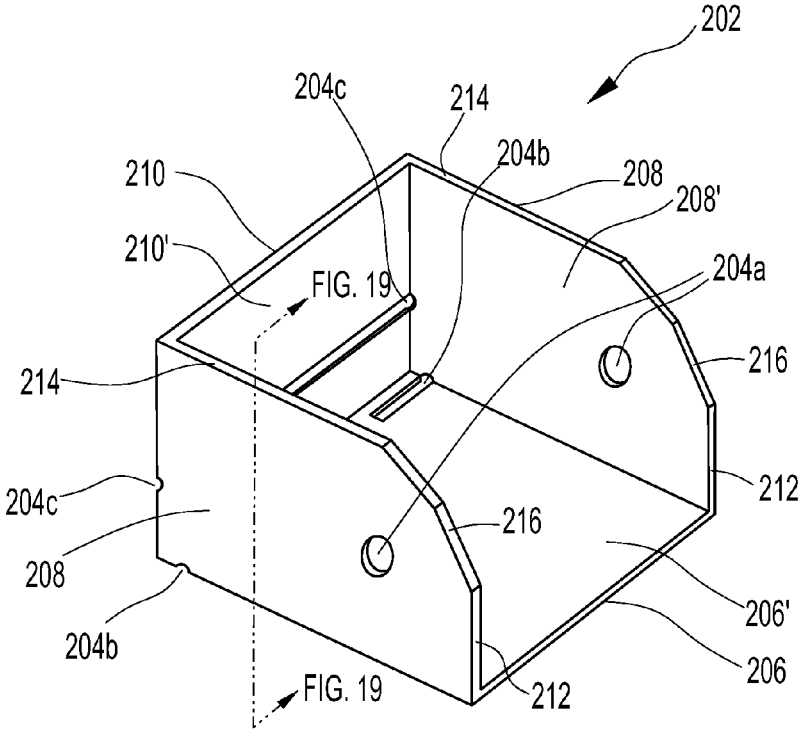

FIG. 18 is a perspective view of another embodiment of a pick hole guard of the present disclosure.

Figure 19:
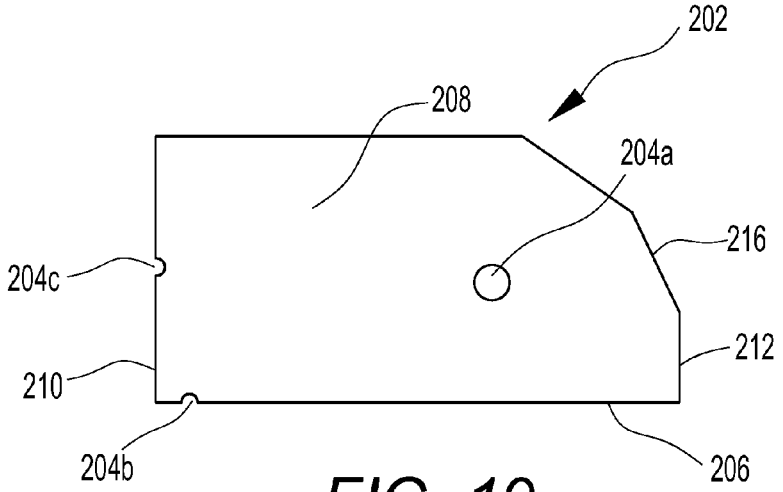

FIG. 19 is an elevation side-view of the pick hole guard of FIG. 18, as viewed from line FIG. 19-FIG. 19 of FIG. 18.

Figure 20:
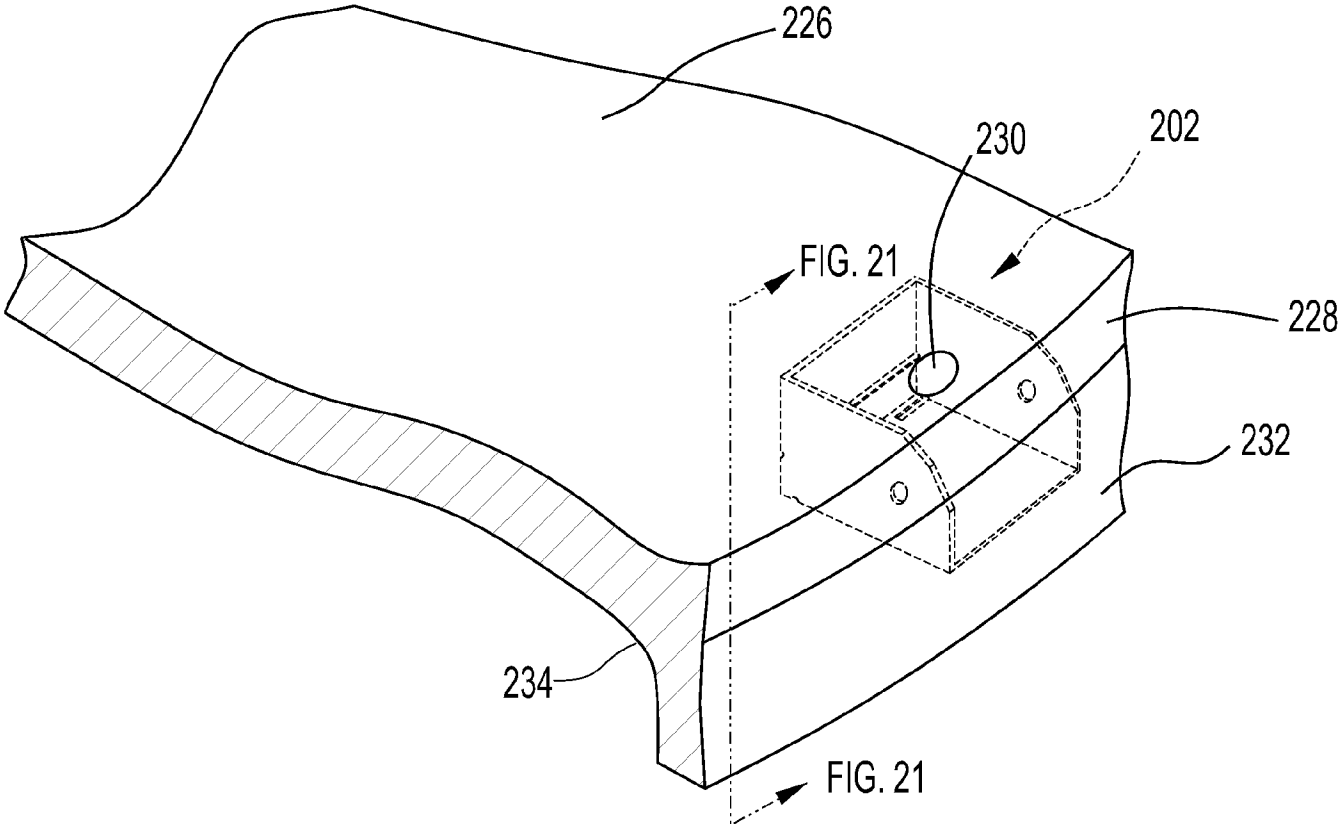

FIG. 20 is a perspective cutaway view of the pick hole guard of FIG. 18, shown coupled to a section of a manhole cover.

Figure 21:
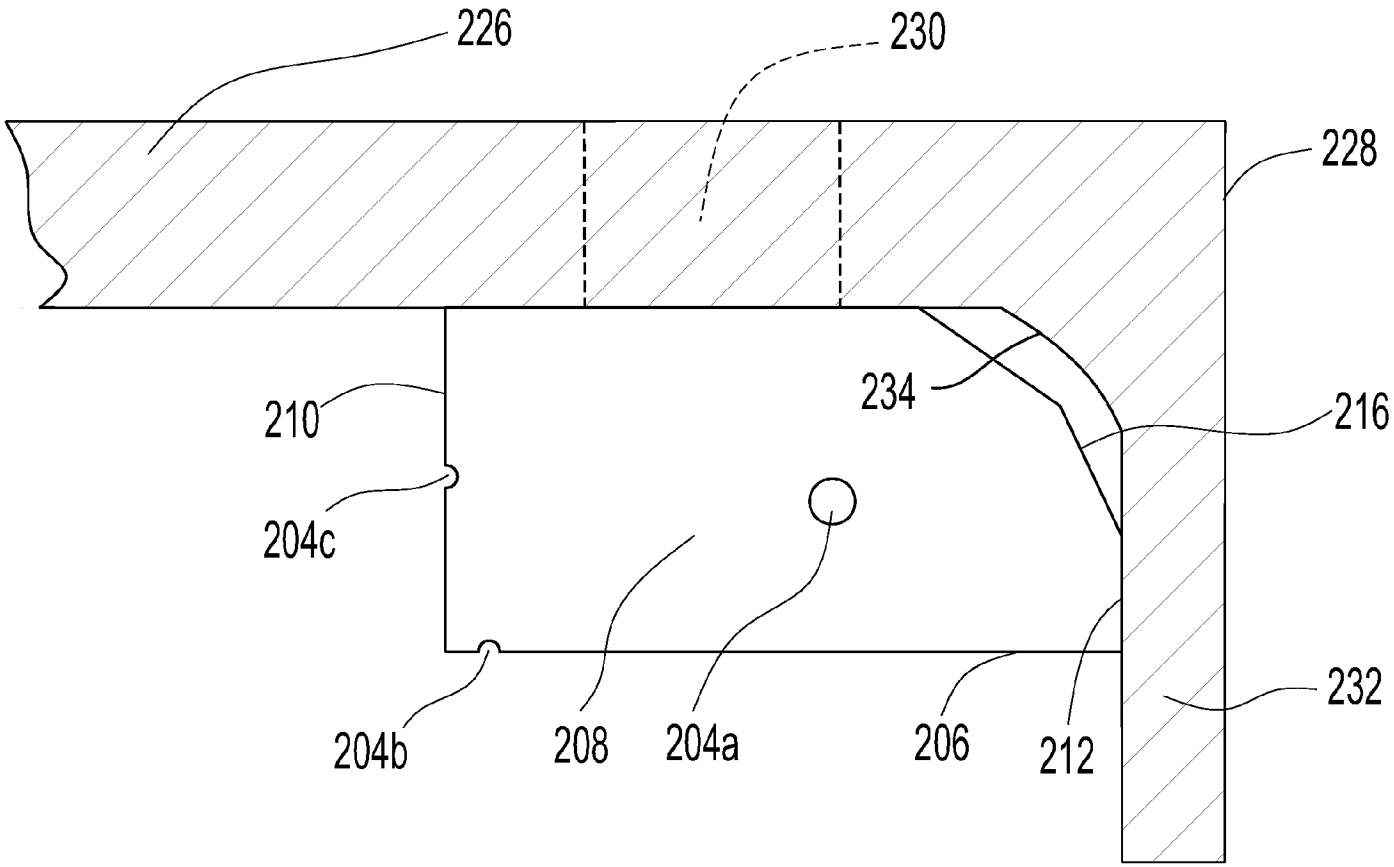

FIG. 21 is a detail cross sectional view of the manhole cover of FIG. 20, also showing the pick hole guard, as viewed from line FIG. 21-FIG. 21 of FIG. 20.

Figure 22B:
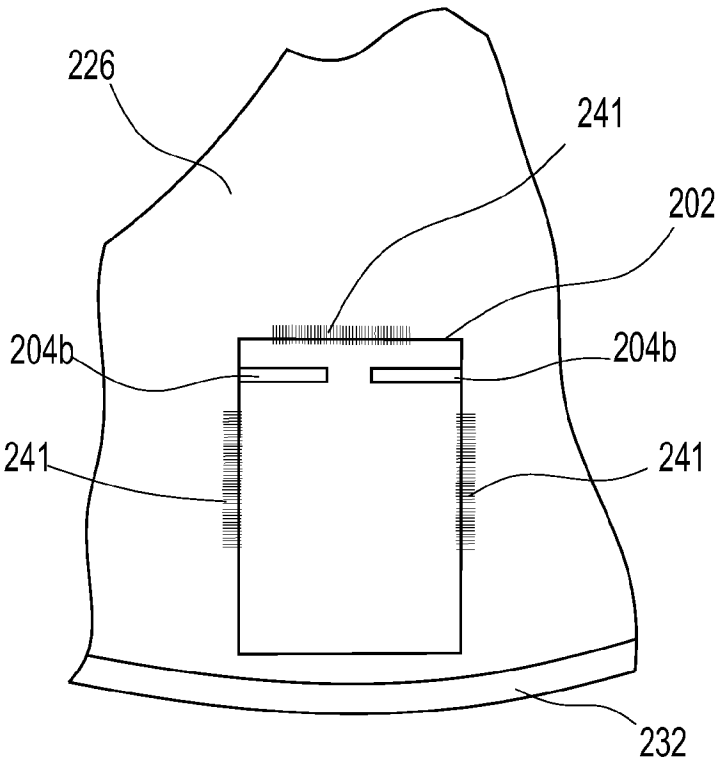
Figure 22A:
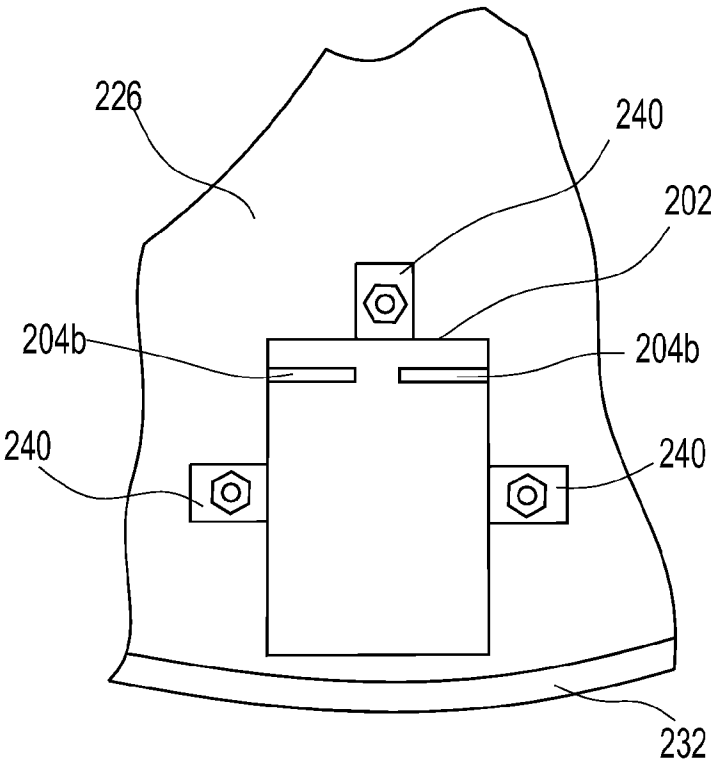

FIG. 22*a* is a plan view of the pick hole guard of FIG. 20, showing the pick hole guard as being bolt-coupled to a bottom surface of the manhole cover.

FIG. 22*b* is a plan view of the pick hole guard of FIG. 20, showing the pick hole guard as being welded to a bottom surface of the manhole cover.

DETAILED DESCRIPTION

In the following description, certain specific details are set forth in order to provide a thorough understanding of various embodiments of the disclosure. However, upon reviewing this disclosure one skilled in the art will understand that the disclosure may be practiced without many of these details. In other instances, well-known structures associated with manholes, manhole covers, and springs have not been described in detail to avoid unnecessarily obscuring the descriptions of the embodiments of the disclosure.

Although various embodiments of the present disclosure are described and illustrated in the context of application to manhole covers, one skilled in the art will understand after reviewing the present disclosure that some embodiments may have applicability in a variety of fields, including on other covering apparatus that have openings which are desired to be secured.

Figure 3:
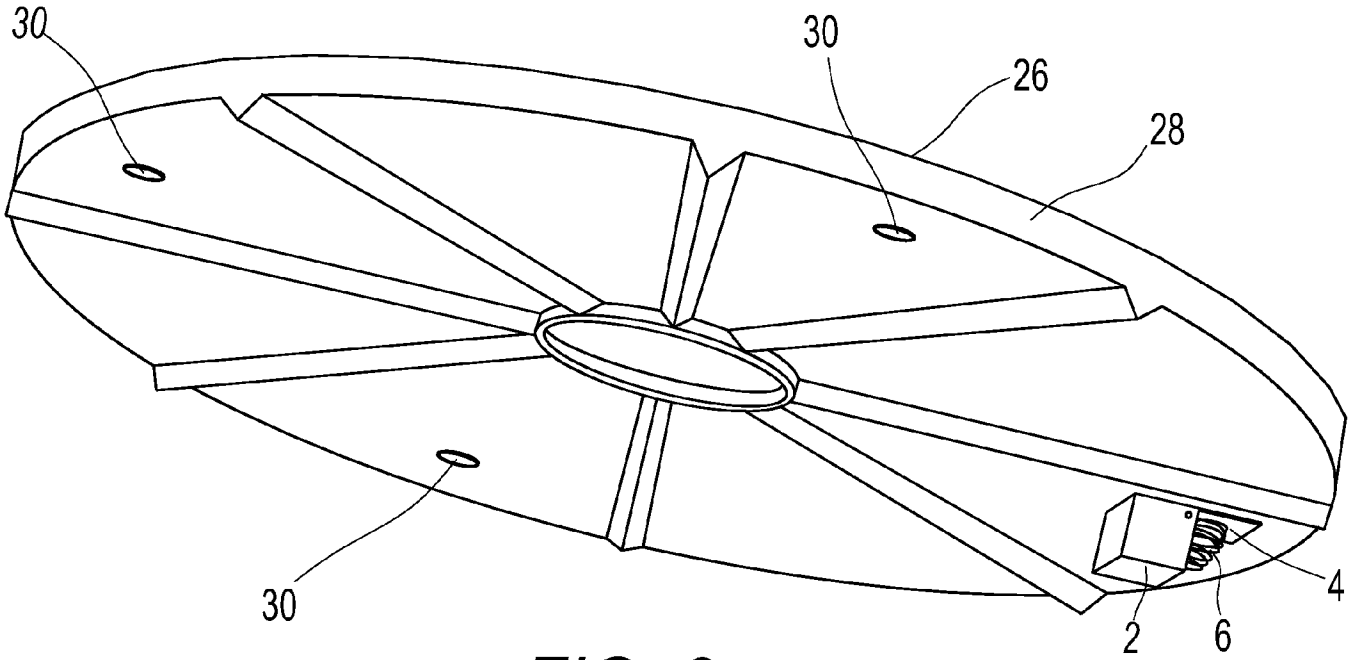
FIG. 3 is a perspective view of a manhole cover having pick holes, with the pick hole guard of FIG. 1 shown attached to the manhole cover and positioned such that a movable guard member of the pick hole guard is positioned over a pick hole.

FIG. 3 shows a manhole cover 26 to which an embodiment of the pick hole guard 2 of the present disclosure is attached. FIG. 3 is provided for illustrative purposes and shows only one pick hole guard 2 connected to the manhole cover 26 to guard a pick hole 30. In some embodiments of the present disclosure, multiple pick hole guards 2 are used in order to guard each pick hole 30.

Figure 1A:
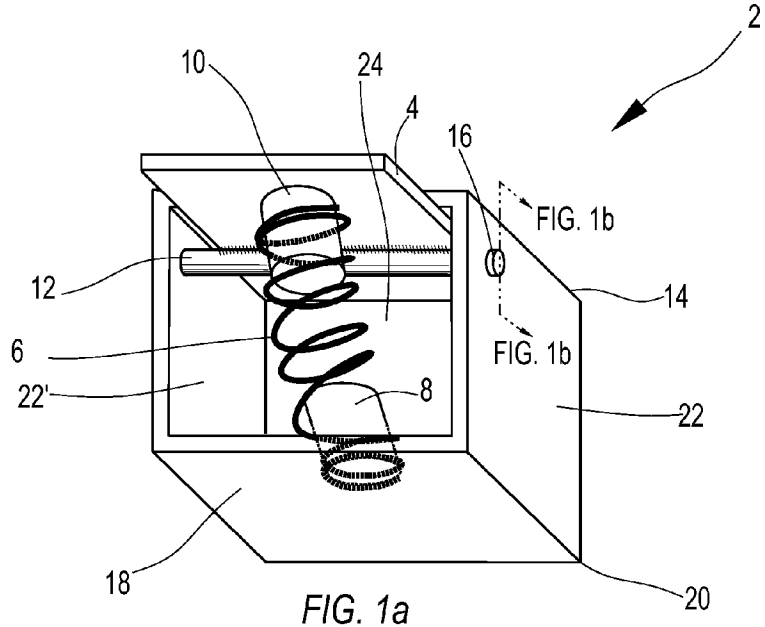
Figure 4:
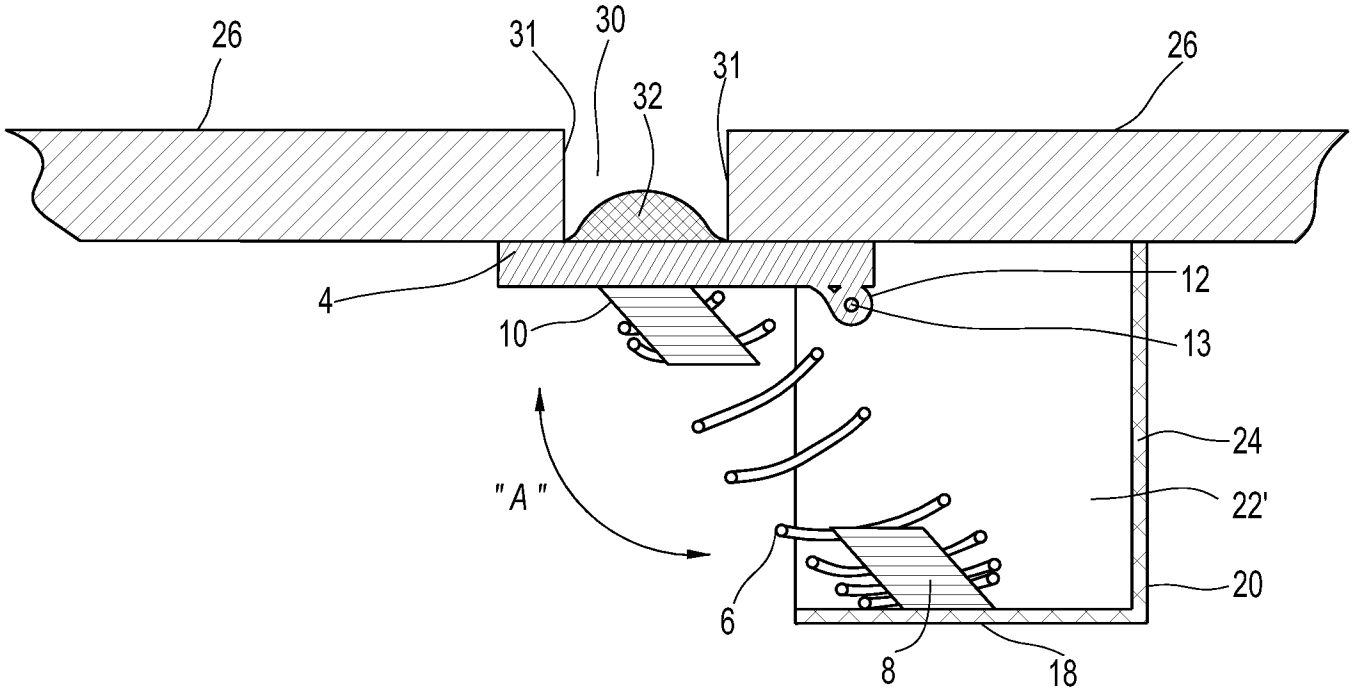
FIG. 4 is a detail cross sectional view of the pick hole guard and manhole cover of FIG. 2 as viewed from line FIG. 4-FIG. 4 of FIG. 2.

FIG. 1*a* is a detail perspective view of an embodiment of the pick hole guard 2 of the present disclosure. The pick hole guard 2 is also shown in FIG. 2 attached to a section of the manhole cover 26. FIG. 4 shows a detail cross sectional view of the pick hole guard 2 as viewed across line FIG. 4-FIG. 4 in FIG. 2.

Now, referring to FIG. 1*a*, the pick hole guard 2 can comprise a movable guard member 4 which can be positioned over a pick hole 30 of the manhole cover. The movable guard member 4 can be a flap or rectangular plate, and can be pivotably connected to a base 20, of the pick hole guard 2. The base 20, or support portion, can have two side walls 22 that are oriented in parallel planes with respect to one another, with each side wall 22 having an inner wall surface 22'. Extending between the side walls 22 can be a top wall 14, a bottom wall 18 and a rear wall 24. In some embodiments of the present disclosure, the top wall 14 is not present.

Figure 1B:
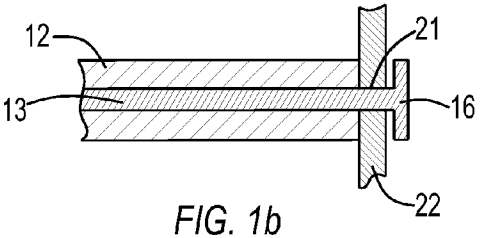

The movable guard member 4 can be connected to the side walls 22 by a pivot rod 12, the pivot rod being formed on, or coupled to, the movable guard member 4 near a rearward section of the movable guard member 4. As will be appreciated by those skilled in the art after reviewing this disclosure, many alternative methods and structures are available for connecting the pivot rod to the base 20 to allow it to pivot. However, in some embodiments of the present disclosure, the pivot rod 12 is tubular and has an inner axial chamber, or passageway, extending laterally through the length of the pivot rod 12. As best seen in FIG. 1*b*, an elongated connection pin 13 can extend through the passageway of the pivot rod 12. A first end portion of the connection pin 13 can extend beyond a first end portion of the pivot rod 12 and through an aperture 21 in one of the side walls 22. A retaining stop 16, as shown in FIGS. 1*a* & 1*b*, can be connected to the first end portion of the connection pin 13, with the retaining stop 16 being larger in diameter than the aperture 21 of the side wall 22 for retaining the connection pin 13 in the sidewall 22, as will be appreciated by those skilled in the art after reviewing this disclosure. An opposite, second end portion, of the retaining pin 13 (not shown) can also extend through an aperture on an opposite side wall 22 of the pick hole guard 2, and can therefore also be retained in the opposite sidewall with a retaining stop. The connection pin 13 can rotate around an axis thereof within the apertures 21 of the sidewalls 22 to allow the movable guard member 4 to pivot about the axis of the pivot rod 12 in a direction substantially illustrated by arrow "A" in FIG. 4.

A biasing member 6, such as coil spring as illustrated in FIGS. 1*a* & 4, can be provided to bias the movable guard member 4 toward an extended position, as shown in FIG. 4. In the extended position, the movable guard member 4 can be adjacent the pick hole 30 to guard the pick hole. In some embodiments of the present disclosure, a seal, or a plug 32, is also provided. The plug 32 can be a raised member attached, or formed on, the movable guard member 4, and protrudes upwardly away from the movable guard member 4. The plug 32 can be centered with the pick hole 30. In this manner, the plug 32 can protrude upward into the pick hole 30, as shown in FIG. 4, when the movable guard member 4 is in the extended position guarding the pick hole 30. The plug 32 can have sufficient diameter to abut against lower sections of the inner sidewalls 31 of the pick hole 30 when the movable guard member 4 is biased against the pick hole 30. The plug 32 can be of a variety of shapes, but in some embodiments, it has a constant radius surface, or partially spherical surface, as will be appreciated by those skilled in the art after reviewing this disclosure. The plug 32 can be formed of the same material as the movable guard member 4.

In the illustrated embodiments of FIGS. 1*a* & 4, the biasing member 6 is a coil spring. The coil spring 6 can be mounted on a spring stud 8 of the support portion 20, and can be retained against the movable guard member 4 by a second spring stud 10. In other embodiments, the biasing member 6 can be, for example, a torsion spring. The torsion spring can be connected to, for example, the top wall 14 of the pick hole guard 2 to stabilize a portion of the torsion spring, and to the movable guard member 4, for biasing the movable guard member as the torsion spring is deflected when the movable guard member is moved, as will be appreciated by those skilled in the art after reviewing this disclosure.

The biasing characteristics of the biasing member 6, including the biasing force, can be selectable, based on particular needs. However, in some embodiments of the present disclosure, the biasing member 6 will be selected to present sufficient force against the movable guard member 4 to hold it in the extended position guarding a pick hole 30 for preventing unwanted intrusion through the pick hole 30 under many circumstances. For example, if the biasing member 6 is selected to have significant enough biasing force such that a person will need a tool (such as a hook rod commonly used to lift manhole covers) to press against the moveable guard member 4 in order to overcome the biasing force, then it is anticipated to prevent many casual disposals of unwanted waste through the pick holes. That is, for example, and without being bound by theory, it is believed that most users of illegal substances will not seek to deposit waste through the pick holes 30 if required to obtain and use a proper tool in order to access the pick holes, as that makes their activity conspicuous and requires significant efforts.

Figure 5:
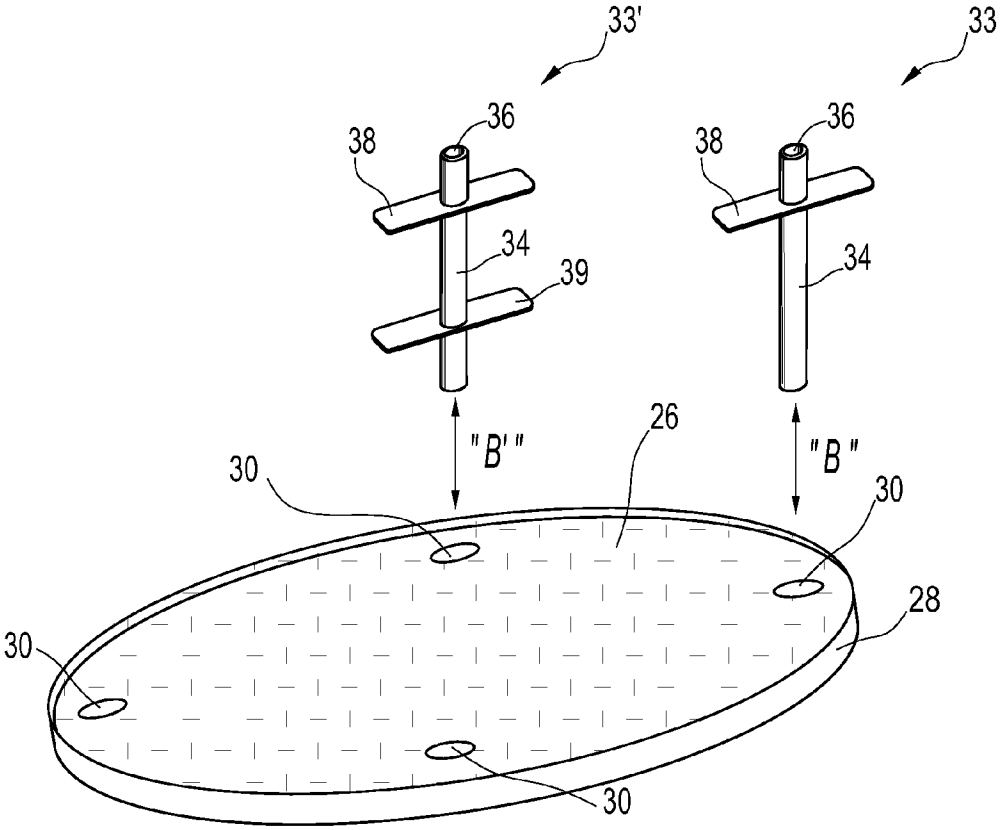
FIG. 5 is a perspective view showing a top side portion of the manhole cover of FIG. 3, also showing embodiments of tubular push rods of the present disclosure.

Referring to FIG. 5, in some embodiments of the present disclosure, a push rod 33 is provided. The push rod 33 can have a body 34 with an axial chamber 36, the axial chamber 36 extending through the length of the body 34 and having an entrance opening at both the top of the push rod 33 and at the bottom of the push rod 33. The push rod 33 can also have push surfaces 38 having receiving planes perpendicular to an axis of the push rod 33, to allow a user to apply force to the push surfaces 38 to push a lower end portion of the push rod through a pick hole 30, as illustrated by arrow "B" in FIG. 5. Using the push rod 33, a user can apply sufficient force to displace the movable guard member 4 blocking a pick hole 30, thereby compressing the biasing member 6 and causing the movable guard member 4 to pivot in the direction of arrow "A" in FIG. 4. Thereafter, a user can utilize the axial chamber 36 of the push rod 33 to sample an environment of the manhole. This can be useful in a variety of circumstances, including for using instruments to sample the environment, as may be required by regulation or policies related to safety and hazards compliance measures.

Still referring to FIG. 5, in further embodiments of the present disclosure, a push rod 33' can be provided with push surfaces 38 & 39 positioned at two different locations along an axis of the push rod 33'. As such, a lower set of push surfaces 39, can serve as stop surfaces to prevent the push rod 33' from being inserted into hole 30 past the longitudinal location of the push surfaces 39, in the downward direction of arrow "B". This can ensure that the upper set of push surfaces 38 remains positioned above, and spaced-apart from, the manhole cover 26 to allow for ease of access to the push surfaces 38 when removing the push rod 33' from the hole 30. As will be appreciated by those skilled in the art after reviewing this disclosure, the push surfaces 38 & 39 can have different shape configurations, and the shapes thereof do not have to be identical. In other embodiments, the shapes of the push surfaces 38 & 39 are the same and either set can serve as the stop surfaces.

FIG. 6*a* shows an example of how the pick hole guard 2 can be conveniently mounted on a bottom surface of the manhole 26, to guard a pick hole 30. In FIG. 6*a*, the pick hole guard 2 is bolted onto the manhole 26. The bolts are connected to wings 40 that are coupled to, or formed on, the pick hole guard 2. This attachment method and structure may be necessary in some circumstances wherein the manhole is constructed of cast iron. FIG. 6*b* shows an alternative mounting method and structure for the pick hole guard, wherein the pick hole guard 2 is welded to the manhole 26. This may be a viable alternative when the material of construction for the manhole 26 is steel. As will be appreciated by those skilled in the art, these are only example alternatives, and other manners of mounting may be employed. In all cases, existing manhole covers can be modified in a cost-effective manner to employ the pick hole guards of the present disclosure.

As will be appreciated by those skilled in the art after reviewing this disclosure, a variety of other configurations are contemplated for the pick hole guard. In some embodiments, a flat spring may be used as the biasing member 6. FIG. 7 is a simplified diagram representing some further embodiments of the pick hole guard, having movable guard member 4'. In the illustrated embodiment, movable guard member 4' is connected to one or more torsion springs 6' and the torsion spring 6' is also connected to a support plate, or base, 14'. In such embodiments, a pivot member may, or may not, be provided between the movable guard member 4' and the support plate 14'. If multiple torsion springs 6' are used, they can be aligned in parallel configuration along the support plate 14' and movable guard member 4' (not illustrated in the drawings), as will be appreciated by those skilled in the art after reviewing this disclosure. In such embodiments, the movable pick hole guard 4' can also be provided with plug 32, which is configured to mate with the pick hole 30 of the manhole cover 26. Biasing member 6' can exert an upward force to bias the movable guard member 4' toward the pick hole 30. A user may use a tool to apply downward force against the movable guard member 4' to cause it to pivot downward in the direction of arrow "C" in order to access to the manhole through the pick hole 30.

Materials of construction for the movable guard members 4, 4' and push rod 33 of the present disclosure include, without limitation, nylon plastic, steel, and aluminum.

In further embodiments of the present disclosure, as shown in FIG. 8, a strip spring arrangement (or leaf spring arrangement) for a pick hole guard 50 is provided. The pick hole guard 50 can have a primary biasing member 52 and a secondary, or reinforcing biasing member 54. The biasing members 52, 54 can be joined at a stationary end portion 56 and can be longitudinally aligned with one another, and can generally extend away from the stationary end portion 56 in diverging fashion.

The biasing members 52, 54 are shown in a stationary position in FIG. 8, however, an end portion 58 of the primary biasing member 52 can be forced in the downward direction of arrow "D," against a biasing force of the biasing member 52, and can be automatically restored in the upward direction of arrow "D" back to the stationary position in FIG. 8 when the downward force is released. In addition, the end portion 58 of the primary biasing member 52 can be forced in the downward direction of arrow "D" until the primary biasing member 52 abuts against a contact surface 60 of the secondary biasing member 54. The contact surface 60 can be formed on the end of an upwardly curving end section 62 of the secondary biasing member 54. If the end portion 58 is forced further downward in the direction of arrow "D," the end section 62 of the secondary biasing member 54 can also be forced downward in the downward direction of arrow "E," against a biasing force of the secondary biasing member 54. As will be understood by those skilled in the art after reviewing this disclosure, the combined biasing force of the biasing members 52, 54 can result in a sudden increase in resistance to the downward force being applied on end portion 58 in the downward direction of arrow "D," when the primary biasing member 52 abuts against the contact surface 60 of the secondary biasing member 54.

The biasing members 52, 54 of the pick hole guard 50 can be made of spring steel and can be formed in the configuration shown in FIG. 8. In some embodiments of the present disclosure, the spring steel is zinc plated. The biasing members 52, 54 can be formed by folding over a single strip of spring steel, with the biasing members 52, 54 thus being joined at the fold, near stationary end portion 56. In addition, it is noted, without limitation, that in some embodiment of the present disclosure, the biasing members 52, 54 can be about 2 inches wide by 1/16 inch thick spring steel—AISI 1050, and heat treated to 46 to 55 hardness after forming.

In further embodiments of the present disclosure, a retaining member 66 is provided for use in coupling the biasing members 52, 54 to the bottom surface of a manhole cover. The retaining member 66 can have a retaining surface 70 that can mate with a bottom surface of the secondary biasing member 54. The retaining member 66 can also comprise a stub out 72 that can fit snugly within an aperture 74 formed through stationary end portion 56 of the biasing members 52, 54. As shown in FIG. 8, the retaining member 66 can thus be attached to the stationary end portion 56 of pick hole guard 50, and the sidewalls 68 of the retaining member 66 can rise along outer edges of the biasing members 52, 54. The retaining member 66 can be made of, for example, mild steel, which can be welded onto the bottom surface of a manhole cover. That is, for example, the side walls 68 of the retaining member 66 can be welded onto the bottom surface of the manhole cover to retain the pick hole guard 50 against the bottom surface of a manhole. The stub out 72 mated within the aperture 74 can help prevent rotation of the biasing members 52, 54 when retained by the retaining member 66. An upper surface 64 of the pick hole guard 50 can be disposed adjacent, and close to, a bottom surface of a manhole cover.

Referring back to FIG. 8, as will be appreciated by those skilled in the art upon reviewing this disclosure, a plug 76 of pick hole guard 50, which can be a protruding member (similar to that of pick hole guard 2 of FIG. 3), can be configured to fit snugly in a pick hole on a manhole cover, thereby providing plugging tendency in the pick hole. The plug can be formed of the same materials of construction as the biasing members 52, 54, or can be different. In some embodiments of the present disclosure, the plug 76 has a diameter of ½ inch to ¾ inch. In other embodiments, the diameter of the plug is greater than ¾ inch, and in other embodiments, it is less than ½ inch.

As will be understood by those skilled in the art after reviewing this disclosure, the existence of both a primary biasing member 52 and a secondary biasing member 54 can provide unique guarding features for a pick hole. For example, a pick hole hook can be inserted into a pick hole to contact the plug 76, with the force applied on the pick hole hook thus forcing the end portion 58 of the primary biasing member downward in the downward direction of arrow "D." The pick hole hook can then be inserted through a pick hole and "hooked" around a bottom surface of the manhole cover to allow a user to lift the manhole cover. In some embodiments of the present disclosure, the end portion 58 of the primary biasing member 52 and the contact surface 60 of the secondary biasing member 54 are spaced far enough apart (e.g. 1 inch) to allow the user of the pick hole hook to insert the hook and lift the manhole cover without having to push the end portion 58 downward so far as to encounter significant resistance from the combination of the primary and secondary biasing members 52, 54. (In some embodiments of the present disclosure, the push rod 33', 33 can also be used without pushing end portion 58 so far downward as to need to counteract the resistance of the both biasing members 52, 54).

At the same time, the existence of the secondary biasing member 54 can further help prevent unwanted intrusion into the manhole cover through a pick hole. That is, for example, if an intruder seeks to insert an long member into the manhole through a pick hole guarded by pick hole guard 50, the intruder could encounter the combined force of the primary and secondary biasing members 52, 54.

In some embodiments of the present disclosure, the pick hole guard 50 can be approximately 7.5 to 8 inches long from end-to-end as measured longitudinally and a distance between the contact surface 60 and the primary biasing member 52 can be about 1 inch, when the pick hole guard 50 is in a resting position. In some embodiments, the secondary biasing member 54 can double the force required to push down on the end portion 58 of the primary biasing member when the primary biasing member abuts against the contact surface 60.

In further embodiments of the present disclosure, a pick hole guard 80 is provided having a hard stop member 82, instead of a secondary biasing member 52, as shown in FIGS. 10-11. In such embodiments, the hard stop member 82 is a solid rigid member that prevents an end portion 88 of a biasing member 84 from being displaced past the hard stop member 82. The hard stop member 82 can have attachment surface 83, which can be attached to a bottom surface of a manhole cover. When the biasing member 84 is fully biased against a manhole cover, the plug 76' of the biasing member can be aligned with a pick hole on a manhole cover. When an end portion 88 of the biasing member is forced downward, it can eventually abut against the hard stop member 82 to prevent the end portion 88 from traveling downward beyond a particular distance. Again, this can prevent unwanted waste from being inserted through the pick hole in a manhole cover, while leaving just enough travel on the end portion 88 to allow a hook to be inserted into the pick hole to in order to catch and lift the manhole cover.

In yet a further embodiment of the present disclosure, as illustrated in FIG. 12, a pick hole guard 90 is provided having a strip-like biasing member 92, but without a secondary biasing member or a hard stop member 82.

As best seen in FIG. 13, a pick hole guard 2' is provided (having similar configuration to the pick hole guard 2 discussed above), except that a hard stop member 18' is provided to prevent the movable guard member 4 from moving downward past the hard stop member 18'. As described above for various embodiments of the pick hole guards of the present disclosure, having resistance to excessive downward movement of a guard member can help prevent unwanted intrusion (such as intrusion by undesirable waste having elongated configurations, like, for example, waste needles) while not preventing a pick hole hook (or push rod 33') from being used to lift the manhole cover (or sample an environment beneath the manhole).

Yet another alternative embodiment of a pick hole guard 100 of the present disclosure is shown in FIGS. 14*a*-15, having a biasing member which can be a torsion spring 106. The torsion spring 106 can be made of, for example, 302 stainless steel, with alternative materials also being suitable materials of construction, as will be appreciated by those skilled in the art after reviewing this disclosure. The pick hole guard 100 can have a base 102 with a curved holder 116 forming an end portion of the base 102. The curved holder 116 can have inner surface 118 for use in retaining the torsion spring 106. The curved holder 116 can also have a retaining gap 122, as best seen in FIG. 15, in which an end portion 124 of the torsion spring 106 can snuggly rest, to assist in retaining the torsion spring 106 in a particular position within the curved holder 116.

The base 102 can have an attachment section 103, usable for welding the base 102 against the bottom surface of a manhole cover. The attachment section 103 can be substantially planar in configuration, and extends away from the curved holder 116. In some embodiments of the present disclosure, the material of construction for the attachment section is mild steel, and the attachment section 103 can be welded to the bottom surface of a manhole cover at, or near, points 103', 103", and 103'", shown in FIG. 14*a*.

Near an end portion of the base 102, opposite the curved holder 116, a plug aperture 110 can be provided. In some embodiments of the present disclosure, the plug aperture 110 is circular in shape.

Referring now to FIGS. 14*a*, 15 and 16 a movable guard member 104, can be attached to the base 102, in pivotable fashion. The movable guard member 104 can have two pivot flaps 108, one on each side thereof, which extend inwardly toward one another. The pivot flaps 108 can each rest within downwardly dipping edge sections 114 of the base 102. In some embodiments of the present disclosure, as best seen in FIG. 14*b*, the pivot flaps 108 are disposed within sleeves 108', that assist the pivot flaps 108 in pivoting within the downwardly dipping edge sections 114. The movable guard member 104 can be pivotable, as shown by arrow "E" in FIG. 16, about a transverse axis extending between the pivot flaps 108, with an end portion of the movable guard member 104 having a plug 112 formed on a top surface thereof, which can protrude up through the plug aperture 110 of the base 102, when the movable guard member 104 is positioned against the base 102. A material of construction of the plug 112 and movable guard member 104 can be 316 stainless steel, in some embodiments of the present disclosure. In other embodiments, the movable guard member 104 can be constructed of different materials, and can be coated with urethane.

As best seen in FIGS. 16 and 17, the biasing member, or torsion spring 106, has an arm 120 that extends longitudinally proximate a bottom surface of the movable guard member 104, and has a generally transversely extending arm portion 122, also extending proximate a bottom surface of the movable guard member 104. In this way, when the movable guard member 104 is pivoted downward in the direction of arrow "E," the arm 120 of the torsion spring 106 provides a biasing force in an opposite direction. As such, similar to various embodiments of the present disclosure disclosed previously, the frequency or likelihood of unwanted intrusion through a pick hole of a manhole cover can be lessened, or prevented. That is, as illustrated in FIG. 16, the pick hole guard 100 can be welded to a manhole 26, with the plug 112 extending upward through the plug aperture 110 and into a pick hole 30, to help seal the pick hole 30. In some embodiments, an authorized user can insert a pick hole hook or a sampling device into the pick hole 30 and push the movable guard member 104 downward in the direction of arrow "E," in order to use the pick hole hook or sampling device, but unwanted intrusion is less likely because intruders will typically lack the appropriate tool to displace the movable guard member 104 sufficiently to dispose of waste through the pick hole 30. The initial biasing force resisting an unwanted intruder attempting to push an object (e.g. needle) through the pick hole 30 to displace the movable guard member 104 downward, can be ten (10) pounds in some embodiments of the present disclosure. As will be appreciated by those skilled in the art upon review of this disclosure, the biasing force can increase as the movable guard member 104 is further displaced, due to characteristics of the torsion spring 106. In other embodiments of the present disclosure, the initial biasing force can be greater or less than ten (10) pounds.

The pick hole guard 100 can be assembled from three separate parts (base 102, torsion spring 106 and movable guard member 104), without the need to weld the parts together. The movable guard member 104 can be mated with the base 102 and held in the position shown in FIG. 16, while the torsion spring 106 is slid into the curved holder 116 in the direction of arrow "F" in FIG. 14*a*, until the end portion 124 of the torsion spring 106 aligns and can be rested within the retaining gap 122, as best seen in FIG. 15. Thereafter, the three separate parts can remain coupled together, while the pick hole guard 100 can be welded to a bottom surface of a manhole cover 26, in a position illustrated in FIG. 16. Each of the pivot flaps 108 can thereafter be retained between a surface of the downwardly dipping edge section 114 of the base 102, and a bottom surface of the manhole cover 26, to allow the pivot flaps 108 to rotate therein when the movable guard member 104 pivots.

FIGS. 18 & 19 show an embodiment of a pick hole guard 202 of the present disclosure without a biasing member. The pick hole guard 202 is also shown in FIGS. 20 & 21 attached to a section of a manhole cover 226.

Now, referring to FIG. 18, the pick hole guard 202, which can be a receptacle, can comprise a bottom wall 206 with inward facing retaining surface 206', side walls 208 that are oriented in parallel planes with respect to one another, with each side wall 208 having an inward facing retaining surface 208', and a rear wall 210 having inward facing retaining surface 210'. One or more of the side walls 208, rear wall 210, and bottom wall 206 can have vent gaps 204*a*, 204*b*, and 204*c*. For example, in the illustrated embodiment, the bottom wall 206 has two vent slits 204*b* (only one of the vent slits 204*b* is visible in FIG. 18, but the second vent slit is positioned to the left of the visible vent slit along the same line of elongation positioned in end-to-end fashion therewith), the rear wall 210 has a vent slit 204*c*, and the side walls 208 each have vent apertures 204*a*. As will be appreciated by those skilled in the art after reviewing this disclosure, different vent gap shapes are also contemplated.

The pick hole guard 202 can be coupled to a bottom side surface of a manhole cover 226 below a pick hole 230 of the manhole cover 226 as illustrated in FIG. 20. FIG. 20 shows a section of a manhole cover 226, including outside rim 228. The illustrated manhole cover 226 also includes a skirt portion 232 that extends below the outside rim 228. The pick hole guard 202 is coupled to a bottom inside face of the manhole cover 226 below a pick hole 230. Edge portions 212 (See FIG. 18) of the side walls 208 are positioned proximate an inside wall of the skirt portion 232. Upper edge surfaces 214 (See FIG. 18) are positioned proximate a bottom surface of the manhole cover 226.

FIG. 21 shows a cross sectional view of the manhole cover 226 (as viewed from line FIG. 21-FIG. 21 of FIG. 20), with pick hole guard 202 attached thereto. As shown in FIG. 21, the tapered wall edge 216 of the pick hole guard 202 can provide clearance for a tapered corner 234 of the manhole cover 226 between the skirt 232 and a bottom surface of the manhole cover 226.

Now referring to FIGS. 18 and 20 simultaneously, it has been observed by the inventors hereof, that when the pick hole guard 202 is coupled to a manhole cover 226 below a pick hole 230, the vent gap layout and illustrated configuration, can help prevent a person from directing a needle through any one of the vent gaps 204*a*, 204*b*, 204*c* from the pick hole 230. That is, for example, a person is unable to angle a needle through pick hole 230 and then through vent apertures 204*a*, and cannot reach the vent apertures 204*b* or 204*c* through pick hole 230. In this manner, the covered manhole can vent, and protection from disposing of needles in the manhole through the pick holes 230 is provided.

In other embodiments of the present disclosure (not shown in the drawings), the tapered edge portion 216 is eliminated and the edge portions 212 of side walls 208 rise substantially straight up to the level of top edge 214, such that the pick hole guard 202 has a box like appearance with an open top. Such versions may be used to provide retaining surfaces on all sides of the pick hole guard 202 when, for example, the manhole covers 226 do not include skirts 232, as will be appreciated by those skilled in the art after reviewing this disclosure.

Also, in some embodiments of the present disclosure, the pick hole guard 202 is pivotably connected to a bottom surface of the manhole cover 226. That is, for example, referring to FIGS. 18 & 21, a mounting member (not illustrated in the drawings) can be provided between the top of rear wall 210 and a bottom surface of the manhole cover 226. The mounting member can be fixedly coupled to the bottom surface of the manhole cover 226, and pivotably coupled to the pick hole guard 202 near top of rear wall 210 by a pivot member (not illustrated), as will be appreciated by those skilled in the art after reviewing this disclosure. As such, the opposite end of the pick hole guard 202, near edge 212, can be pulled away from the manhole cover 226 while the pick hole guard 202 pivots around the pivot member, in order to allow a user to empty contents of the pick hole guard 202. Also, in some embodiments of the present disclosure, the pick hole guard 202 can be locked in place when pivoted into the position shown in FIG. 21, using a locking mechanism (not shown) as will be appreciated by those skilled in the art after reviewing this disclosure.

FIG. 22*a* shows an example of how the pick hole guard 202 can be conveniently and fixedly mounted on a bottom surface of the manhole 226, to guard a pick hole 230. In FIG. 22*a*, which is viewed from below the manhole cover 226 looking up, the pick hole guard 202 is bolted onto the manhole 226. The bolts are connected to wings 240 that are coupled to, or formed on, the pick hole guard 202. This attachment method and structure may be necessary in some circumstances wherein the manhole is constructed of cast iron. FIG. 22*b* shows an alternative mounting method and structure for the pick hole guard 202, wherein the pick hole guard 202 is welded 241 to the manhole cover 226. This may be a viable alternative when the material of construction for the manhole cover 226 is steel. As will be appreciated by those skilled in the art, these are only example alternatives, and other manners of mounting may be employed. In all cases, existing manhole covers can be modified in a cost-effective manner, by simply coupling the pick hole guards 202 of the present disclosure to the manhole covers 226 below pick holes 230 thereof.

Materials of construction for the pick hole guard 202 include, without limitation, nylon plastic, steel, and aluminum.

Although specific embodiments and examples of the disclosure have been described supra for illustrative purposes, various equivalent modifications can be made without departing from the spirit and scope of the disclosure, as will be recognized by those skilled in the relevant art after reviewing the present disclosure. The various embodiments described can be combined to provide further embodiments. The described devices and methods can omit some elements or acts, can add other elements or acts, or can combine the elements or execute the acts in a different order than that illustrated, to achieve various advantages of the disclosure. These and other changes can be made in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. A manhole cover assembly comprising:

a movable guard member at least partially disposed below a bottom facing surface of the manhole cover;

a base coupled to the bottom facing surface of the manhole cover; and a biasing member attached to the base and attached to the movable guard member and configured to bias the movable guard member toward a pick hole of the manhole cover with at least ten pounds of force, the biasing member, base, and movable guard member being together configured to guard the pick hole and require at least ten pounds of force to displace the movable guard member away from the pick hole.

2. The manhole cover assembly of claim 1 wherein the base comprises a curved holder that retains the biasing member at least partially on an inner surface of the curved holder.

3. The manhole cover assembly of claim 1 wherein the biasing member is a torsion spring.

4. The manhole cover assembly of claim 1 wherein the movable guard member has a protruding portion that extends into the pick hole when the movable guard member is positioned proximate the pick hole and guarding the pick hole.

5. The manhole cover assembly of claim 1 wherein a plurality of pivot members are formed on the movable guard member, and wherein the pivot members rest on an upward facing surface of the base with the bottom surface of the manhole cover being disposed directly above the pivot members, the movable guard member being pivotable about a longitudinal axis of the pivot members.

6. The manhole cover assembly of claim 1 wherein the base comprises an aperture aligned with the pick hole.

7. The manhole cover assembly of claim 1 wherein the movable guard member is formed with a plurality of inwardly extending pivot members that are each positioned within a downwardly dipping edge section of the base.

8. A manhole assembly comprising:

a manhole cover having at least one pick hole formed thereon;

a movable guard member disposed at least partially below a bottom facing surface of the manhole cover and guarding the at least one pick hole;

a base welded to the bottom facing surface of the manhole cover; and a biasing member attached to the base and the movable guard member and biasing the movable guard member toward the at least one pick hole on the manhole cover to guard the at least one pick hole.

9. The manhole assembly of claim 8 wherein the base comprises a substantially planar attachment surface that is welded to the bottom surface of the manhole cover, and the base further comprises an aperture aligned with the pick hole, and wherein the movable guard member is biased against the base.

10. The manhole assembly of claim 8 wherein the biasing member is a torsion spring having an arm portion extending forward from a rear section of the base toward a front section of the base.

11. The manhole assembly of claim 8 wherein the base comprises a holder for retaining the biasing member and wherein the holder has a retaining gap formed on an edge of wall of the holder through which an end portion of the biasing member extends.

12. The manhole assembly of claim 8 wherein the movable guard member has at least one pivot member extending inward from each side of the movable guard member, the movable guard member being pivotable about an axis extending through the pivot members.

13. The manhole assembly of claim 12 wherein each of the pivot members rests in a downwardly dipping edge section of the base.

14. The manhole assembly of claim 8 further comprising a push rod having an internal chamber extending through the length of the push rod with an opening on each end portion of the push rod, the push rod being configured for insertion through the pick hole.

15. The manhole assembly of claim 14 wherein at least 10 pounds of force is required to displace the movable guard member away from the pick hole.

* * * * *